US009742076B2

(12) United States Patent
Jenwatanavet et al.

(10) Patent No.: US 9,742,076 B2
(45) Date of Patent: Aug. 22, 2017

(54) SPACE EFFICIENT MULTI-BAND ANTENNA

(71) Applicant: QUALCOMM Incorporated, San Diego, CA (US)

(72) Inventors: Jatupum Jenwatanavet, San Diego, CA (US); Yuandan Dong, San Diego, CA (US); Andrew PuayHoe See, San Diego, CA (US); Allen Minh-Triet Tran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 76 days.

(21) Appl. No.: 14/828,360

(22) Filed: Aug. 17, 2015

(65) Prior Publication Data

US 2017/0054220 A1 Feb. 23, 2017

(51) Int. Cl.

| | |
|---|---|
| ***H01Q 1/24*** | (2006.01) |
| ***H01Q 21/06*** | (2006.01) |
| ***H01Q 9/42*** | (2006.01) |
| ***H01Q 5/321*** | (2015.01) |
| ***H01Q 5/335*** | (2015.01) |
| ***H01Q 5/378*** | (2015.01) |
| ***H01Q 1/38*** | (2006.01) |

(52) U.S. Cl.

CPC ..... *H01Q 21/06* (2013.01); *H01Q 1/38* (2013.01); *H01Q 5/321* (2015.01); *H01Q 5/335* (2015.01); *H01Q 5/378* (2015.01); *H01Q 9/42* (2013.01); *H01Q 1/243* (2013.01)

(58) Field of Classification Search

CPC ..... H01Q 1/24; H01Q 21/28; H01Q 1/243; H01Q 5/10; H01Q 5/15; H01Q 5/314; H01Q 9/06; H01Q 21/06

USPC ..... 343/700 MS, 702, 725, 727, 745, 876

See application file for complete search history.

(56) References Cited

U.S. PATENT DOCUMENTS

| | | | | |
|---|---|---|---|---|
| 7,812,773 | B2 | 10/2010 | Qi et al. | |
| 8,472,904 | B2 | 6/2013 | White | |
| 8,970,433 | B2 | 3/2015 | Kenoun et al. | |
| 9,350,069 | B2 * | 5/2016 | Pascolini | H01Q 1/243 |
| 9,680,223 | B2 * | 6/2017 | Wu | H01Q 5/378 |
| 2007/0035446 | A1 * | 2/2007 | Pan | H01Q 1/243 343/700 MS |
| 2009/0284433 | A1 | 11/2009 | Tsutsumi et al. | |
| 2012/0146865 | A1 | 6/2012 | Hayashi et al. | |
| 2013/0141291 | A1 * | 6/2013 | Luan | H01Q 1/243 343/745 |

(Continued)

OTHER PUBLICATIONS

International Search Report and Written Opinion—PCT/US2016/043202—ISA/EPO—Sep. 28, 2016.

Co-pending U.S. Appl. No. 14/592,746, filed Jan. 8, 2015.

*Primary Examiner* — Tho G Phan

(74) *Attorney, Agent, or Firm* — Paradice and Li LLP/Qualcomm

(57) ABSTRACT

A multi-band antenna having an aperture tuner is disclosed. The multi-band antenna may simultaneously transmit a first radio frequency (RF) signal and a second RF signal. The aperture tuner may modify a resonant frequency associated with one or more antenna elements of the multiband antenna in accordance with the first RF signal or the second RF signal. One or more of the antenna elements of the multi-band antenna may be disposed above and/or substantially parallel to other antenna elements. In some exemplary embodiments, an air gap may be formed between one or more antenna elements.

16 Claims, 8 Drawing Sheets

(56) References Cited

U.S. PATENT DOCUMENTS

| | | | | |
|---|---|---|---|---|
| 2014/0015721 | A1 | 1/2014 | Yukimoto et al. | |
| 2014/0266922 | A1 | 9/2014 | Jin et al. | |
| 2014/0333495 | A1* | 11/2014 | Vazquez | H01Q 9/06 343/745 |
| 2015/0145744 | A1 | 5/2015 | Kao et al. | |
| 2015/0180118 | A1* | 6/2015 | Huang | H01Q 1/526 343/841 |

* cited by examiner

SPACE EFFICIENT MULTI-BAND ANTENNA

TECHNICAL FIELD

The exemplary embodiments relate generally to antennas, and specifically to a space efficient multi-band antenna.

BACKGROUND OF RELATED ART

A wireless device (e.g., a cellular phone or a smartphone) in a wireless communication system may transmit and receive data for two-way communication. The wireless device may include a transmitter for data transmission and a receiver for data reception. For data transmission, the transmitter may modulate a radio frequency (RF) carrier signal with data to generate a modulated RF signal, amplify the modulated RF signal to generate a transmit RF signal having the proper output power level, and transmit the transmit RF signal via an antenna to another device such as, for example, a base station. For data reception, the receiver may obtain a received RF signal via the antenna and may amplify and process the received RF signal to recover data sent by the other device.

The wireless device may operate within multiple frequency bands. For example, the wireless device may transmit and/or receive an RF signal within a first frequency band and/or within a second frequency band. In many cases, an antenna design for the wireless device may depend on the frequency band used during operation. Different frequency bands (having different associated wavelengths) often dictate different antenna sizes. For example, a length of an antenna element may be selected to be a wavelength multiple ($\lambda/4$, $\lambda/2$ etc.) of the RF signal. Thus, an antenna designed for use within the first frequency band may have a different antenna element length compared to an antenna designed for use within the second frequency band. Using separate antennas for each frequency band may increase the size, cost, and/or complexity of the wireless device.

Thus, there is a need to reduce the number of antennas and/or size of antennas used by wireless devices that operate within multiple frequency bands.

BRIEF DESCRIPTION OF THE DRAWINGS

The exemplary embodiments are illustrated by way of example and are not intended to be limited by the figures of the accompanying drawings. Like numbers reference like elements throughout the drawings and specification.

DETAILED DESCRIPTION

In the following description, numerous specific details are set forth such as examples of specific components, circuits, and processes to provide a thorough understanding of the present disclosure. The term "coupled" as used herein means coupled directly to or coupled through one or more intervening components or circuits. Also, in the following description and for purposes of explanation, specific nomenclature and/or details are set forth to provide a thorough understanding of the exemplary embodiments. However, it will be apparent to one skilled in the art that these specific details may not be required to practice the exemplary embodiments. In other instances, well-known circuits and devices are shown in block diagram form to avoid obscuring the present disclosure. Any of the signals provided over various buses described herein may be time-multiplexed with other signals and provided over one or more common buses. Additionally, the interconnection between circuit elements or software blocks may be shown as buses or as single signal lines. Each of the buses may alternatively be a single signal line, and each of the single signal lines may alternatively be buses, and a single line or bus might represent any one or more of a myriad of physical or logical mechanisms for communication between components. The exemplary embodiments are not to be construed as limited to specific examples described herein but rather to include within their scope all exemplary embodiments defined by the appended claims.

In addition, the detailed description set forth below in connection with the appended drawings is intended as a description of exemplary embodiments of the present disclosure and is not intended to represent the only exemplary embodiments in which the present disclosure may be practiced. The term "exemplary" used throughout this description means "serving as an example, instance, or illustration," and should not necessarily be construed as preferred or advantageous over other exemplary embodiments.

Further, combinations such as "at least one of A, B, or C," "at least one of A, B, and C," and "at least A or B or C or a combination thereof" include any combination of A, B, and/or C, and may include multiples of A, multiples of B, or multiples of C. Specifically, combinations such as "at least A or B or C or a combination thereof," "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C.

Figure 1:
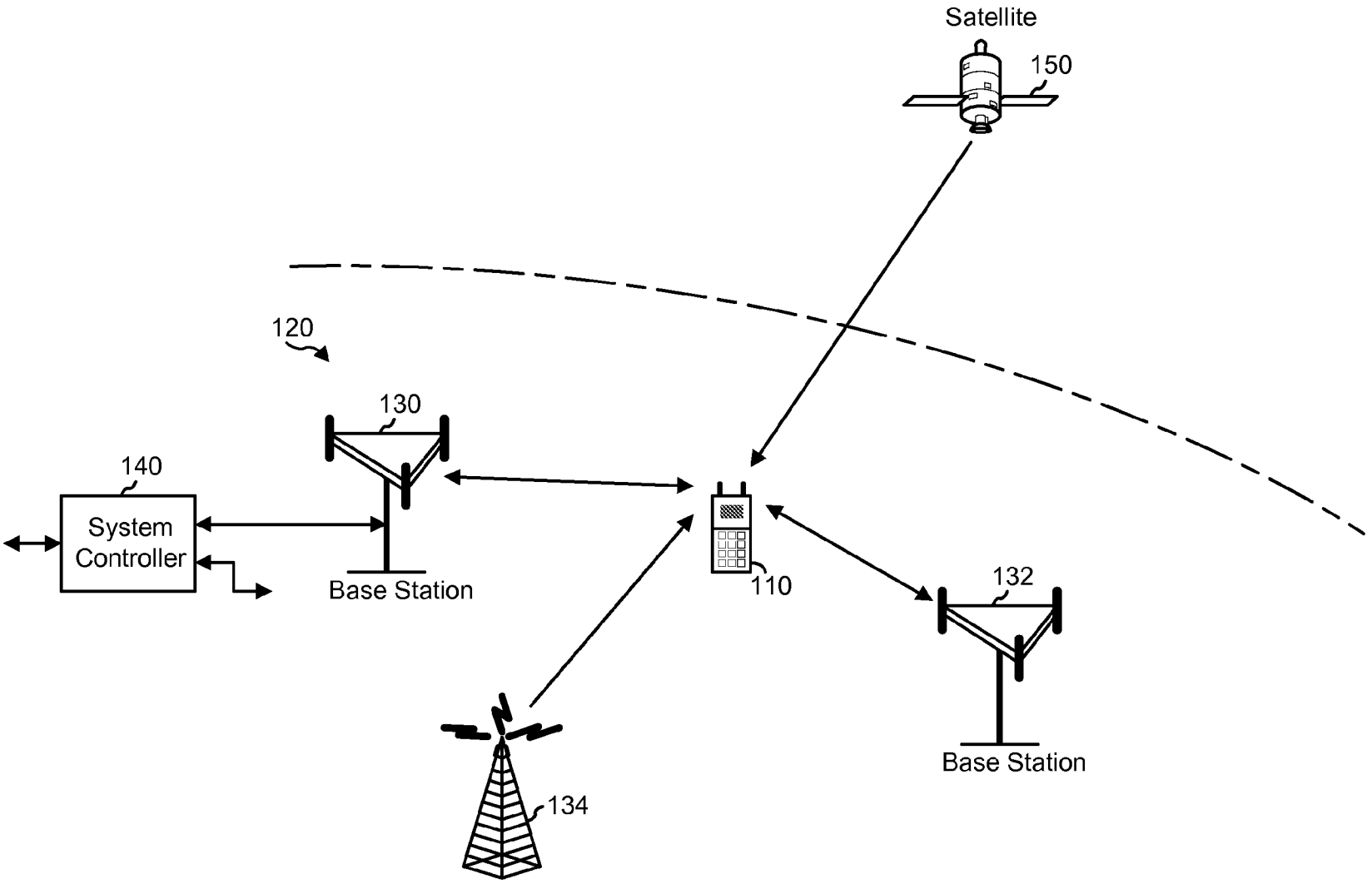
FIG. 1 shows a wireless device communicating with a wireless communication system, in accordance with some exemplary embodiments.

FIG. 1 shows a wireless device 110 communicating with a wireless communication system 120, in accordance with some exemplary embodiments. Wireless communication system 120 may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA. For simplicity, FIG. 1 shows wireless communication system 120 including two base stations 130 and 132 and one system controller 140. In general, a wireless system may include any number of base stations and any set of network entities.

Wireless device 110 may also be referred to as a user equipment (UE), a mobile station, a terminal, an access terminal, a subscriber unit, a station, etc. Wireless device 110 may be a cellular phone, a smartphone, a tablet, a wireless modem, a personal digital assistant (PDA), a handheld device, a laptop computer, a smartbook, a netbook, a cordless phone, a wireless local loop (WLL) station, a Bluetooth device, etc. Wireless device 110 may communicate with wireless communication system 120. Wireless device 110 may also receive signals from broadcast stations (e.g., a broadcast station 134), signals from satellites (e.g., a satellite 150) in one or more global navigation satellite systems (GNSS), etc. Wireless device 110 may support one or more radio technologies for wireless communication such as LTE, WCDMA, CDMA 1×, EVDO, TD-SCDMA, GSM, 802.11, etc.

Figure 2:
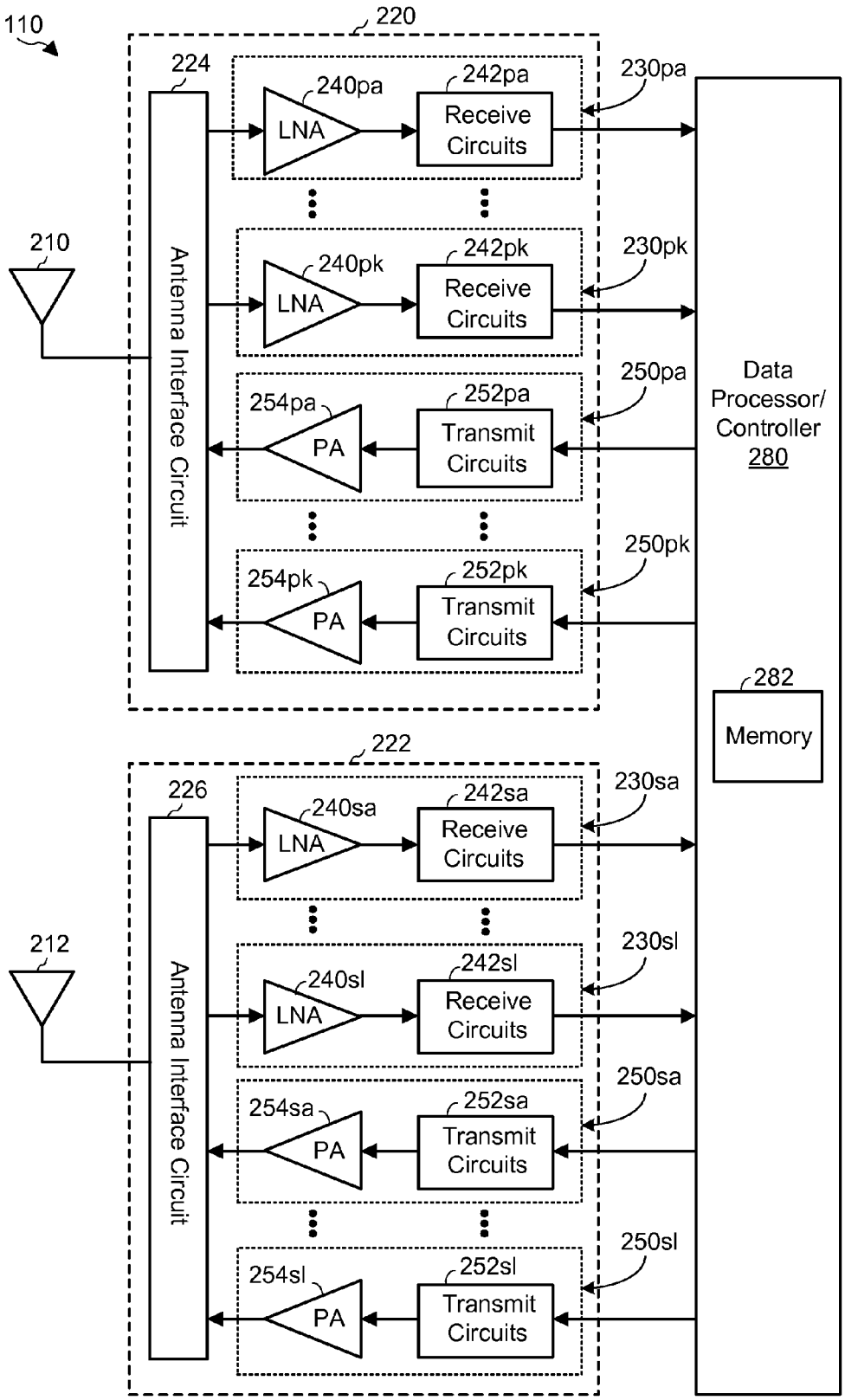
FIG. 2 shows an exemplary design of a receiver and a transmitter of FIG. 1.

FIG. 2 shows a block diagram of an exemplary design of wireless device 110 in FIG. 1. In this exemplary design, wireless device 110 includes a primary transceiver 220 coupled to a primary antenna 210, a secondary transceiver 222 coupled to a secondary antenna 212, and a data processor/controller 280. Primary transceiver 220 includes a number (K) of receivers 230*pa* to 230*pk* and a number (K) of transmitters 250*pa* to 250*pk* to support multiple frequency bands, multiple radio technologies, carrier aggregation, etc. Secondary transceiver 222 includes a number (L) of receivers 230*sa* to 230*sl* and a number (L) of transmitters 250*sa* to 250*sl* to support multiple frequency bands, multiple radio technologies, carrier aggregation, receive diversity, multiple-input multiple-output (MIMO) transmission from multiple transmit antennas to multiple receive antennas, etc.

In the exemplary design shown in FIG. 2, each receiver 230 (e.g., 230*pa*-230*pk* and 230*sa*-230*sl*) includes a low noise amplifier (LNA) 240 (e.g., 240*pa*-240*pk* and 240*sa*-240*sl*) and receive circuits 242 (e.g., 242*pa*-242*pk* and 242*sa*-242*sl*). For data reception, primary antenna 210 receives signals from base stations and/or other transmitter stations and provides a received radio frequency (RF) signal, which is routed through an antenna interface circuit 224 and presented as an input RF signal to a selected receiver. Antenna interface circuit 224 may include switches, duplexers, transmit filters, receive filters, matching circuits, etc. The description below assumes that receiver 230*pa* is the selected receiver. Within receiver 230*pa*, an LNA 240*pa* amplifies the input RF signal and provides an output RF signal. Receive circuits 242*pa* downconvert the output RF signal from RF to baseband, amplify and filter the downconverted signal, and provide an analog input signal to data processor/controller 280. Receive circuits 242*pa* may include mixers, filters, amplifiers, matching circuits, an oscillator, a local oscillator (LO) generator, a phase locked loop (PLL), etc. Each remaining receiver 230 in primary transceiver 220 may operate in a similar manner as receiver 230*pa*. Receivers 230*sa*-230*sl* and associated antenna interface circuit 226 within secondary transceiver 222 may operate in a similar manner as receiver 230*pa*.

In the exemplary design shown in FIG. 2, each transmitter 250 (e.g., 250*pa*-250*pk* and 250*sa*-250*sl*) includes transmit circuits 252 (e.g., 252*pa*-252*pk* and 252*sa*-252*sl*) and a power amplifier (PA) 254 (e.g., 254*pa*-254*pk* and 254*sa*-254*sl*). For data transmission, data processor/controller 280 processes (e.g., encodes and modulates) data to be transmitted and provides an analog output signal to a selected transmitter. The description below assumes that transmitter 250*pa* is the selected transmitter. Within transmitter 250*pa*, transmit circuits 252*pa* amplify, filter, and upconvert the analog output signal from baseband to RF and provide a modulated RF signal. Transmit circuits 252*pa* may include amplifiers, filters, mixers, matching circuits, an oscillator, an LO generator, a PLL, etc. A PA 254*pa* receives and amplifies the modulated RF signal and provides a transmit RF signal having the proper output power level. The transmit RF signal is routed through antenna interface circuit 224 and transmitted via primary antenna 210. Each remaining transmitter 250 in transceivers 220 and 222 may operate in similar manner as transmitter 250*pa*.

Each receiver 230 and transmitter 250 may also include other circuits not shown in FIG. 2, such as filters, matching circuits, etc. All or a portion of transceivers 220 and 222 may be implemented on one or more analog integrated circuits (ICs), RF ICs (RFICs), mixed-signal ICs, etc. For example, LNAs 240 and receive circuits 242 within transceivers 220 and 222 may be implemented on multiple IC chips, as described below. The circuits in transceivers 220 and 222 may also be implemented in other manners.

Data processor/controller 280 may perform various functions for wireless device 110. For example, data processor/controller 280 may perform processing for data being received via receivers 230 and data being transmitted via transmitters 250. Data processor/controller 280 may control the operation of the various circuits within transceivers 220 and 222. A memory 282 may store program codes and data for data processor/controller 280. Data processor/controller 280 may be implemented on one or more application specific integrated circuits (ASICs) and/or other ICs.

Figure 3:
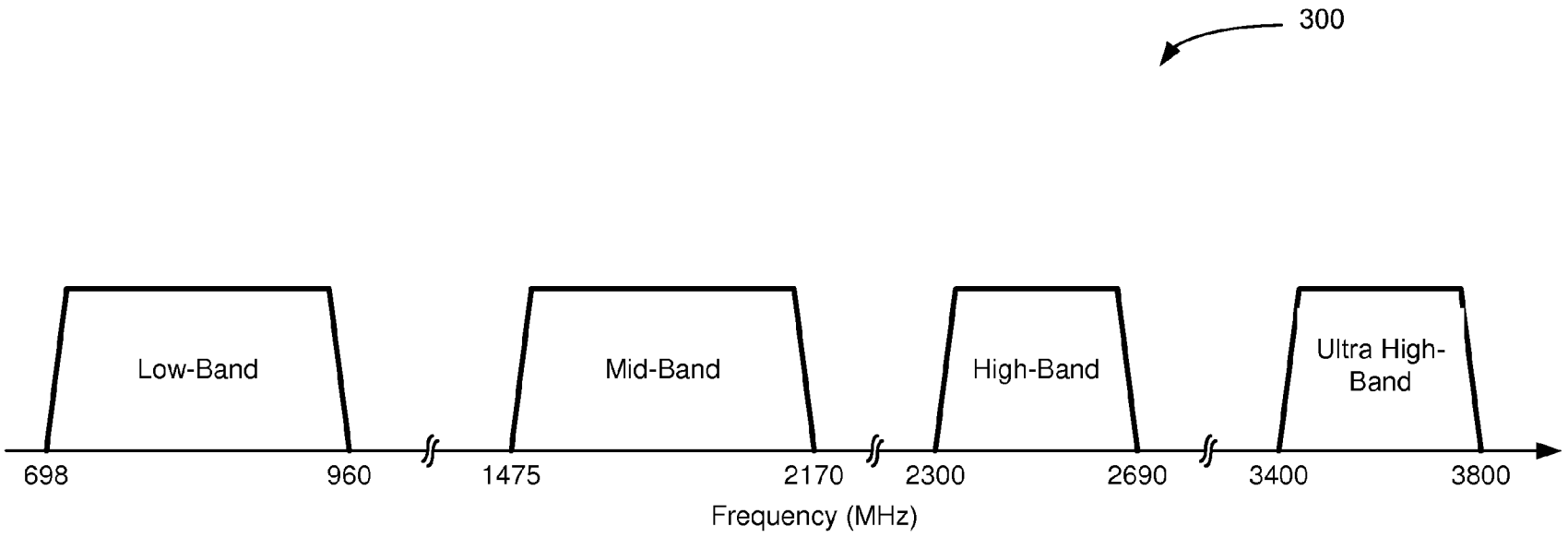
FIG. 3 is a band diagram depicting three exemplary band groups that may be supported by the wireless device of FIG. 1.

FIG. 3 is a band diagram 300 depicting three exemplary band groups that may be supported by wireless device 110. In some exemplary embodiments, wireless device 110 may operate in a low-band (LB) including RF signals having frequencies lower than 1000 megahertz (MHz), a mid-band (MB) including RF signals having frequencies from 1000 MHz to 2300 MHz, a high-band (HB) including RF signals having frequencies from 2300 MHz to 2700 MHz, and/or an ultra-high-band (UHB) including RF signals having frequencies higher than 3400 MHz. For example, low-band RF signals may cover from 698 MHz to 960 MHz, mid-band RF signals may cover from 1475 MHz to 2170 MHz, and high-band RF signals may cover from 2300 MHz to 2690 MHz and ultra-high-band RF signals may cover from 3400 MHz to 3800 MHz and 5000 MHz to 5800 MHz, as shown in FIG. 3. Low-band, mid-band, and high-band, and ultra-high band refer to four groups of bands (or band groups), with each band group including a number of frequency bands (or simply, "bands"). LTE Release 11 supports 35 bands, which are referred to as LTE/UMTS bands and are listed in 3GPP TS 36.101.

In general, any number of band groups may be defined. Each band group may cover any range of frequencies, which may or may not match any of the frequency ranges shown in FIG. 3. Each band group may also include any number of bands.

Figure 4:
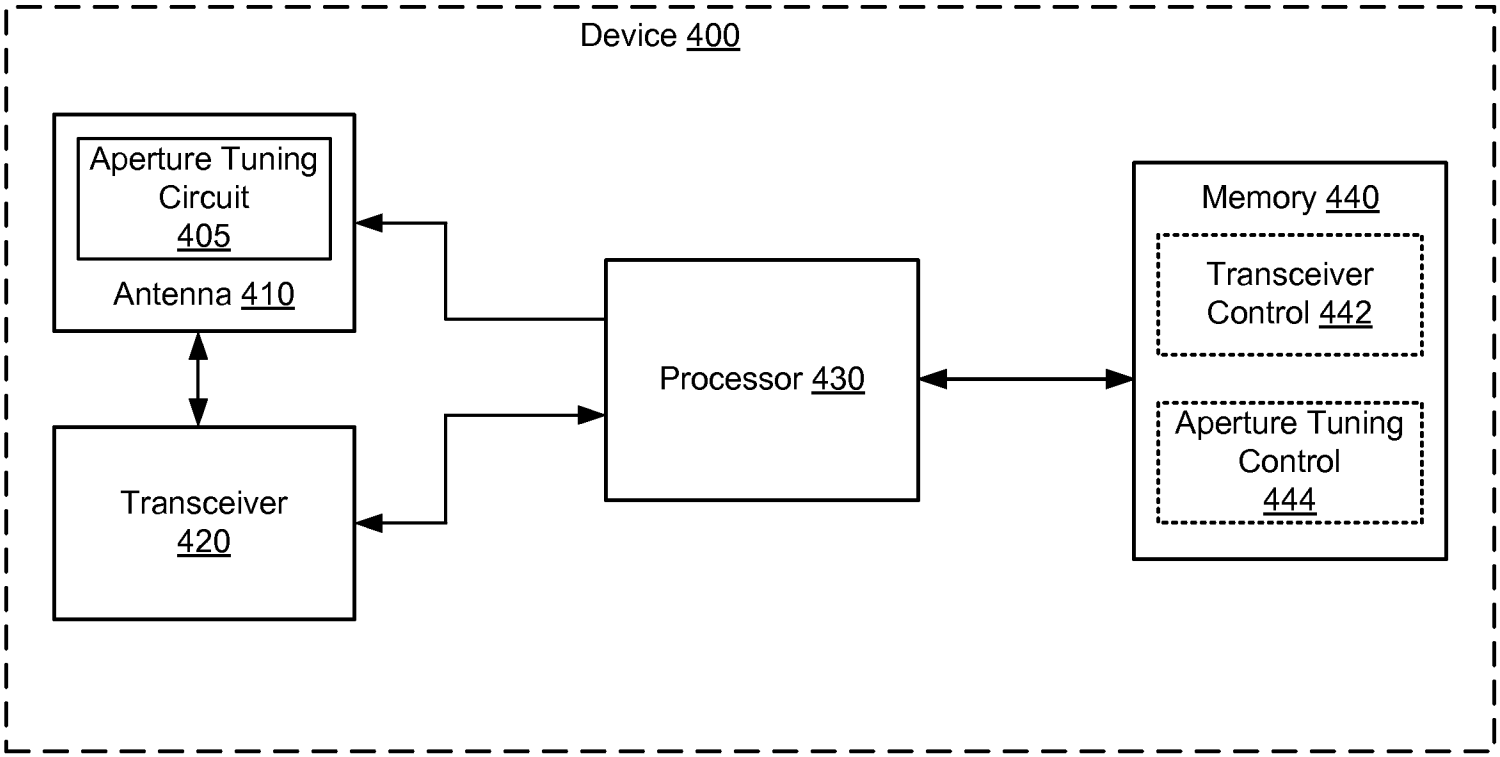
FIG. 4 depicts a device that is another exemplary embodiment of the wireless device of FIG. 1.

FIG. 4 depicts a device 400 that is another exemplary embodiment of wireless device 110 of FIG. 1. Device 400 includes an antenna 410, a transceiver 420, a processor 430, and a memory 440. In some exemplary embodiments, antenna 410 may be another exemplary embodiment of primary antenna 210 and/or secondary antenna 212 described above. Although a single antenna 410 is shown here, in other exemplary embodiments, device 400 may include two or more antennas (not shown for simplicity). In a similar manner, although a single transceiver 420 is shown here, in other exemplary embodiments, device 400 may include two or more transceivers (not shown for simplicity). For example, device 400 may include a plurality of transceivers to transmit and/or receive different RF signals within different frequency bands, and/or different RF streams within a similar frequency band for multiple-input multiple output (MIMO) communication. In some exemplary embodiments, two or more transceivers may simultaneously transmit and/or receive RF signals through different frequency bands to implement carrier aggregation.

Antenna 410 may include an aperture tuning circuit 405 coupled to one or more antenna elements (not shown in FIG. 4 for simplicity) of antenna 410 to modify a resonant frequency and/or modify an effective length associated with the one or more antenna elements. Aperture tuning circuit 405 is described in more detail below in conjunction with FIGS. 5-6.

Memory 440 may include a non-transitory computer-readable storage medium (e.g., one or more nonvolatile memory elements, such as EPROM, EEPROM, Flash memory, a hard drive, etc.) that may store the following software modules:

- a transceiver control module 442 to select frequency bands within which to operate transceiver 420; and
- an aperture tuning control module 444 to tune antenna 410 based on one or more selected frequency bands.

Each software module includes program instructions that, when executed by processor 430, may cause the device 400 to perform the corresponding function(s). Thus, the non-transitory computer-readable storage medium of memory 440 may include instructions for performing all or a portion of the operations of FIG. 9.

Processor 430, which is coupled to antenna 410, transceiver 420, and memory 440, may be any one or more suitable processors capable of executing scripts or instructions of one or more software programs stored in device 400 (e.g., within memory 440).

Processor 430 may execute transceiver control module 442 to select one or more frequency bands within which to operate transceiver 420. For example, transceiver control module 442 may select a 900 MHz frequency band and/or a 1700 MHz frequency band to operate transceiver 420. In other exemplary embodiments, transceiver 420 may select other frequency bands to operate within.

Processor 430 may execute aperture tuning control module 444 to tune antenna 410 based on at least one of the selected frequency bands used by transceiver 420. For example, when transceiver control module 442 operates transceiver 420 within the 900 MHz frequency band and the 1700 MHz frequency band, then aperture tuning control module 444 may control aperture tuning circuit 405 to tune one or more antenna elements of antenna 410 to have resonant frequencies associated with the 900 MHz frequency band and/or the 1700 MHz frequency band. In some exemplary embodiments, antenna 410 may include a parasitic antenna element for use within one or more frequency bands associated with antenna 410. Operation of aperture tuning control module is described in more detail below in conjunction with FIGS. 5-9.

Figure 5:
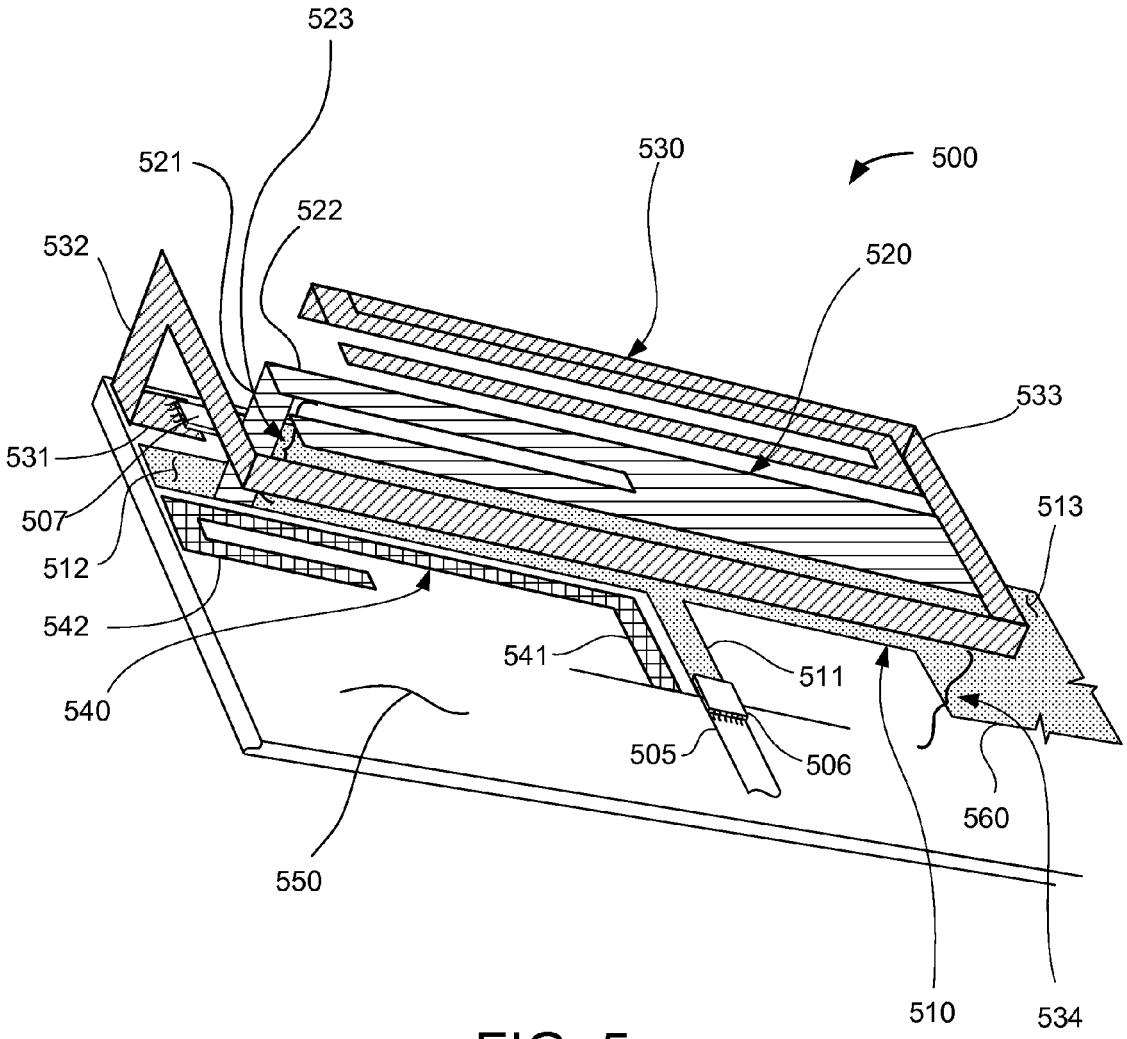
FIG. 5 is a perspective view of an exemplary embodiment of an antenna 500.

FIG. 5 is a perspective view of an exemplary embodiment of an antenna 500. Antenna 500 may be another exemplary embodiment of antenna 410, primary antenna 210, and/or secondary antenna 212. Antenna 500 may include a first antenna element 510 (shown dotted), a second antenna element 520 (shown with horizontal stripes), a third antenna element 530 (shown with diagonal stripes), a parasitic antenna element 540 (shown with cross-hatched stripes), a feed point 505, an impedance matching circuit 506, and an aperture tuner 507. In some exemplary embodiments, some or all portions of antenna 500 may be disposed on a substrate 550. Example embodiments of substrate 550 may include printed circuit boards having conductive circuits (e.g., traces) and/or components on one or both sides, fiberglass, plastic, or other dielectric material, and/or a conductive material (e.g., aluminum, copper, etc.). First antenna element 510, second antenna element 520, third antenna element 530, and parasitic antenna element 540 may formed from any technically feasible conductive material such as copper, aluminum, steel, and/or a metallic covered or plated insulator such as a conductive foil over plastic.

A transceiver within wireless device 110 (not shown for simplicity) may be coupled to antenna 500 via feed point 505. Impedance matching circuit 506, coupling feed point 505 to first antenna element 510, may match an impedance associated with antenna 500 to a desired impedance. In some exemplary embodiments, the desired impedance may be associated with a transmission line (also not shown for simplicity) coupling the transceiver to feed point 505. Impedance matching circuit 506 may include one or more reactive circuit elements (e.g., capacitors and/or inductors) to match the impedance associated with antenna 500 to the desired impedance.

First antenna element 510 may include a first portion 511, a second portion 512, and a third portion 513. In other exemplary embodiments, first antenna element 510 may include different numbers of portions. First portion 511 may be coupled to feed point 505 through impedance matching circuit 506. First portion 511 may receive an RF signal through feed point 505. Second portion 512 may be coupled to first portion 511 and may form a first end of first antenna element 510. In some exemplary embodiments, second portion 512 may be coupled to first portion 511 at substantially right angles (e.g., substantially perpendicular). In a similar manner, third portion 513 may be coupled to first portion 511 at substantially right angles and may form a second end of the first antenna element 510. In some exemplary embodiments, first portion 511 may be disposed between second portion 512 and third portion 513. In some exemplary embodiments, third portion 513 may integrally form a ground plane 560. In other exemplary embodiments, third portion 513 may integrally form a reference plane (e.g., a plane coupled to a reference voltage other than ground). In still other exemplary embodiments, different antenna portions, more antenna portions, and/or fewer antenna portions may be disposed on, coupled to, and/or integrally formed with ground plane 560. In some exemplary embodiments, first portion 511, second portion 512, and third portion 513 may be substantially coplanar.

Second antenna element 520 may include a fourth portion 521 and a fifth portion 522. In other exemplary embodiments, second antenna element 520 may include different numbers of portions. Fourth portion 521 may be coupled to second portion 512 of first antenna element 510 (e.g., the first end of antenna element 510). Fifth portion 522 may be coupled to fourth portion 521. In some exemplary embodiments, fifth portion 522 may be disposed above and substantially parallel to first antenna element 510. Fourth portion 521 may be substantially perpendicular to both second portion 512 and fifth portion 522. In some exemplary embodiments, fifth portion 522 may include a first surface facing toward (e.g., oriented proximally with respect to) first antenna element 510 and a second surface facing away from (e.g., oriented distally with respect to) first antenna element 510.

Fifth portion 522 may be separated (e.g., positioned) away from first antenna element 510 by fourth portion 521 and may form a first gap, such as first air gap 523. First air gap 523 may enable one or more circuit components (e.g., resistors, capacitors, integrated circuits) to be disposed (e.g., mounted) between fifth portion 522 and first antenna element 510.

First antenna element 510 and second antenna element 520 may form, at least in part, a first composite antenna element. In some exemplary embodiments, the first composite antenna element may operate (e.g., radiate and/or receive RF signals) within a first frequency band (e.g., a frequency $f_1$ associated with wavelength $\lambda_1$). Thus, a length or width associated with first antenna element 510 and/or second antenna element 520 may be associated with wavelength $\lambda_1$. For example, a combined length of first antenna element 510 and second antenna element 520 may be a multiple of $\lambda_1$ (e.g., $\lambda_1/4$).

Parasitic antenna element 540 may include a sixth portion 541 and a seventh portion 542. In other exemplary embodiments, parasitic antenna element 540 may include different numbers of portions. Sixth portion 541 may be coupled to ground plane 560 (not shown for simplicity). Seventh portion 542 may be coupled to sixth portion 541 at substantially right angles. In some exemplary embodiments, sixth portion 541 and seventh portion 542 may be substantially coplanar. In some exemplary embodiments, parasitic antenna element 540 may be inductively and/or magnetically coupled to first antenna element 510 and/or second antenna element 520. Thus, together with first antenna element 510 and/or second antenna element 520, parasitic antenna element 540 may operate within the first frequency band and may be included within the first composite antenna element. Parasitic antenna element 540 may increase an effective length associated with first antenna element 510 and/or second antenna element 520, thereby extending the bandwidth associated with first antenna element 510 and/or second antenna element 520.

Third antenna element 530 may be coupled to first antenna element 510 through aperture tuner 507. In some exemplary embodiments, third antenna element 530 may include an eighth portion 531, a ninth portion 532, and a tenth portion 533. In other exemplary embodiments, third antenna element 530 may include different numbers of portions. Eighth portion 531 may be coupled to aperture tuner 507. Eighth portion 531 may form a first end of third antenna element 530 and may be disposed on substrate 550. Ninth portion 532 may be coupled to eighth portion 531 may extend away from substrate 550. In some exemplary embodiments, ninth portion 532 may be substantially perpendicular to eighth portion 531. Tenth portion 533 may be coupled to ninth portion 532 and may be substantially perpendicular to ninth portion 532. Tenth portion 533 may form a second end of third antenna element 530 and may be disposed above and substantially parallel to first antenna element 510.

In some exemplary embodiments, first antenna element 510, second antenna element 520, third antenna element 530, and or parasitic antenna element 540 may include a serpentine portion enabling additional antenna element length to be added to the associated antenna element, while limiting a related antenna element size.

In some exemplary embodiments, first antenna element 510 and third antenna element 530 may form a second composite antenna element. The second composite antenna element and may operate (e.g., radiate and/or receive RF signals) within a second frequency band (e.g., a frequency $f_2$ associated with wavelength $\lambda_2$). Thus, a length or width associated with second composite antenna may be associated with wavelength $\lambda_2$.

In some exemplary embodiments, antenna 500 may operate within a plurality of frequency bands. For example, first antenna element 510 and second antenna element 520 may operate within a first frequency band and first antenna element 510 and third antenna element 530 may operate within a second frequency band, different than the first frequency band. In another example, the first composite antenna element may operate within the first frequency band and the second composite antenna element may operate within the second frequency band. In some exemplary embodiments, operation within the first frequency band and the second frequency band may be relatively simultaneous, thereby enabling carrier aggregation.

In some exemplary embodiments, tenth portion 533 may be separated by a second gap, such as second air gap 534 from first antenna element 510. In some exemplary embodiments, second air gap 534 may be different from first air gap 523. Second air gap 534 may enable one or more components to be mounted between tenth portion 533 and first antenna element 510.

Aperture tuner 507 may adjust a resonant frequency (e.g., adjust an effective length) associated with third antenna element 530 and first antenna element 510. Thus, aperture tuner 507 may enable first antenna element 510 and second antenna element 520 to be tuned to various operating frequencies independent of first antenna element 510 and third antenna element 530. In some exemplary embodiments, aperture tuner 507 may lower the resonant frequency associated with first antenna element 510 and third antenna element 530 compared to resonant frequencies associated with first antenna element 510 and second antenna element 520. Thus, frequency $f_2$ may be tuned lower than frequency $f_1$. In other exemplary embodiments, first air gap 523 and/or second air gap 534 may also be modified to tune resonant frequencies associated with first antenna element 510, second antenna element 520, and/or third antenna element 530. Operation of aperture tuner 507 is described in more detail below in conjunction with FIGS. 6A and 6B.

Figure 6A:
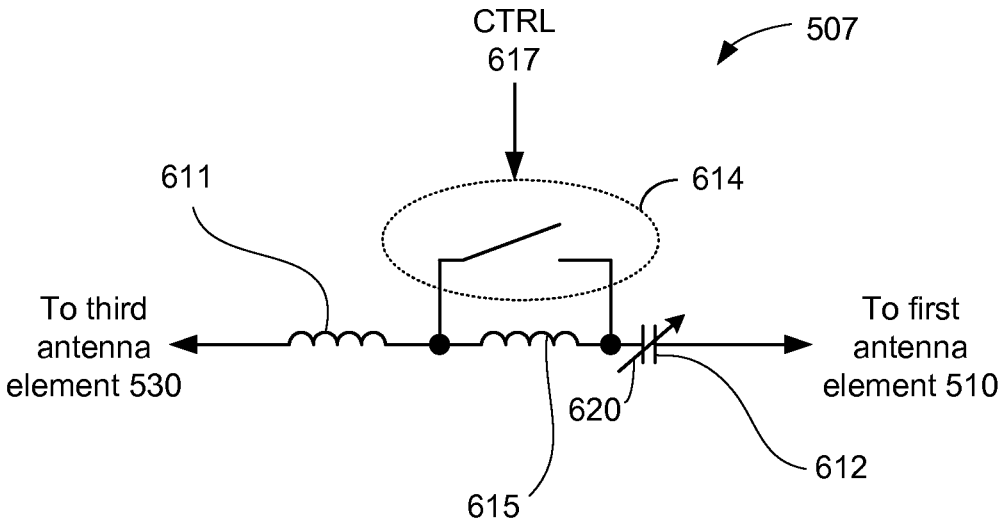
FIG. 6A is shows an exemplary embodiment of an aperture tuner.

FIG. 6A shows an exemplary embodiment of aperture tuner 507 of FIG. 5. Aperture tuner 507 may include a first inductor 611, a varactor (e.g., variable capacitor) 612, switch 614, and a second inductor 615. In other exemplary embodiments, aperture tuner 507 may include different numbers of inductors, switches, and/or varactors. In at least one exemplary embodiment, first inductor 611 may couple third antenna element 530 (not shown for simplicity) to second inductor 615 which, in turn, may be coupled to varactor 612. Varactor 612 may be coupled to first antenna element 510 (also not shown for simplicity). In some exemplary embodiments, varactor 612 may be coupled to ground (e.g., ground plane 560) through first antenna element 510. In other exemplary embodiments, first inductor 611 and varactor 612 may be coupled to other antenna elements.

Switch 614, which is coupled in parallel with second inductor 615, may selectively isolate second inductor 615 from first antenna element 510 and/or third antenna element 530, for example, to vary the resonant frequency associated with first antenna element 510 and/or third antenna element 530. Switch 614 may be controlled by control signal (CTRL) 617 to modify the resonant frequency associated with first antenna element 510 and/or third antenna element 530. In some exemplary embodiments, CTRL 617 may be generated by aperture tuning control module 444. In other exemplary embodiments, CTRL 617 may be provided by an aperture tuner controller described below in conjunction with FIG. 7. In some exemplary embodiments, the reactance of aperture tuner 507 may be varied by changing varactor control signal 620 of varactor 612, thereby changing an associated capacitance of varactor 612. In a similar manner, the reactance of aperture tuner 507 may be varied by controlling switch 614 via CTRL 617 to couple reactive components to, or isolate reactive components from, first antenna element 510 and/or third antenna element 530. Varying the reactance of aperture tuner 507 may vary a resonant frequency associated with first antenna element 510 and/or third antenna element 530. For example, closing switch 614 may isolate second inductor 615 from aperture tuner 507, thereby increasing frequency $f_2$. In another example, increasing the capacitance value of varactor 612 may lower frequency $f_2$. In some exemplary embodiments, aperture tuner 507 may operate as a low pass filter to limit frequencies of RF signals that may be coupled through aperture tuner 507. For example, first inductor 611 and/or second inductor 615 may operate as elements of the low pass filter to limit RF signal frequencies.

In some exemplary embodiments, varactor control signal 620 and/or configuration of switch 614 may be controlled by an aperture tuner controller 702 described below in conjunction with FIG. 7. Persons skilled in the art will recognize that other circuits and components (e.g., biasing components, current sources, power supplies, and so forth) may be omitted from FIG. 6A for simplicity.

Figure 6B:
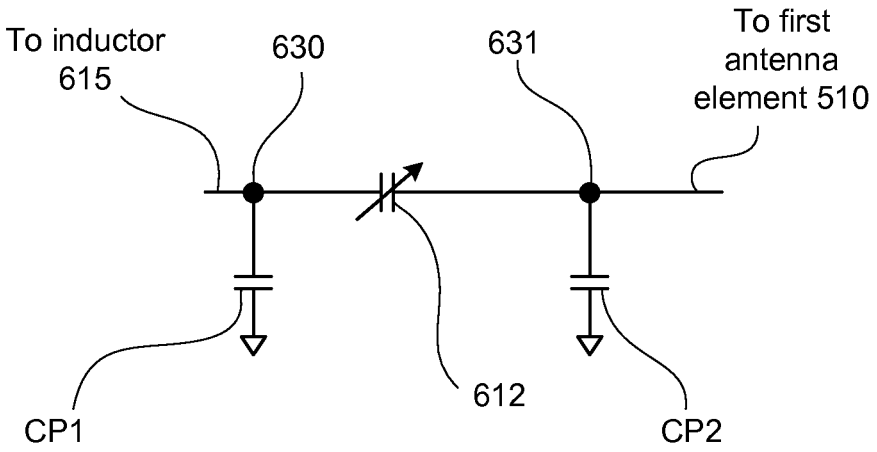
FIG. 6B shows parasitic capacitances associated the aperture tuner.

FIG. 6B shows parasitic capacitances associated with aperture tuner 507. A first parasitic capacitance CP1 may be coupled between a first terminal 630 of varactor 612 and ground. A second parasitic capacitance CP2 may be coupled between a second terminal 631 of varactor 612 and ground. In some exemplary embodiments, first parasitic capacitance CP1 and second parasitic capacitance CP2 may reduce a bandwidth associated with antenna 410 and/or antenna 500. Introducing varactor 612 between first parasitic capacitance CP1 and second parasitic capacitance CP2 may reduce effects of one or more of the parasitic capacitances. For example, second parasitic capacitance CP2 (as shown) may be coupled in parallel with varactor 612. The parallel coupling of varactor 612 and second parasitic capacitance CP2 may increase a tuning range associated with varactor 612. In addition, the capacitance associated with first parasitic capacitance CP1 may be eliminated by coupling one side of varactor 612 to ground (e.g., through first antenna element 510).

Figure 7:
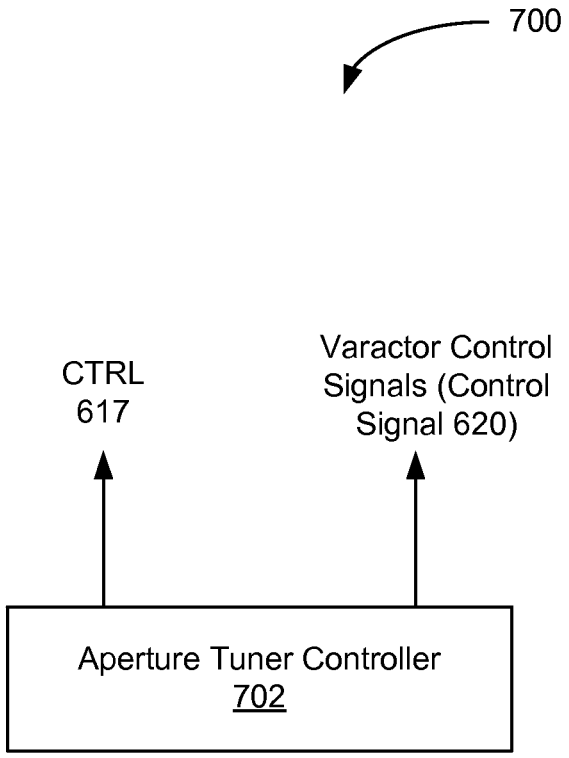
FIG. 7 is a block diagram of an aperture tuner controller, in accordance with exemplary embodiments.

FIG. 7 is a block diagram 700 of an aperture tuner controller 702, in accordance with exemplary embodiments. Aperture tuner controller 702 may control aperture tuner 507 (of FIG. 5) to vary a resonant frequency and/or effective length associated with one or more antenna elements, such as first antenna element 510 and third antenna element 530 (not shown in FIG. 7 for simplicity). In other exemplary embodiments, aperture tuner controller 702 may control any technically feasible aperture tuner circuit coupled between any two or more antenna elements. In at least one exemplary embodiment, a resonant frequency and/or an effective length associated with first antenna element and/or third antenna element 530 may be modified based on a wavelength $\lambda_2$ of the second RF signal. In some exemplary embodiments, the effective length of first antenna element 510 and/or third antenna element 530 may be varied by varying a reactance associated with aperture tuner 507.

In one exemplary embodiment, the reactance associated with aperture tuner 507 may be varied by adjusting varactor control signal 620 of varactor 612, thereby changing a capacitance associated with aperture tuner 507. In another exemplary embodiment, the reactance may be varied by controlling switch 614 via CTRL 617 to couple reactive components to, or isolate reactive components from, circuit pathways associated with aperture tuner 507. In still other exemplary embodiments, aperture tuner controller 702 may provide control signals for any technically feasible number of varactors and may control any technically feasible number of switches that may be included within aperture tuner 507. Varactor control signal 620 and/or configuration of switch 614 may be based on the wavelength of the RF signal to be received and/or radiated by the first antenna element 510 and/or third antenna element 530. For example, first antenna element 510 and third antenna element 530 may be characterized prior to use by wireless device 110. After a wavelength of the RF signal coupled to the first antenna element 510 and third antenna element 530 is determined, aperture tuner controller 702 may control varactor control signal 620 and/or configure switch 614 to vary the resonant frequency and/or effective length accordingly.

Figure 8:
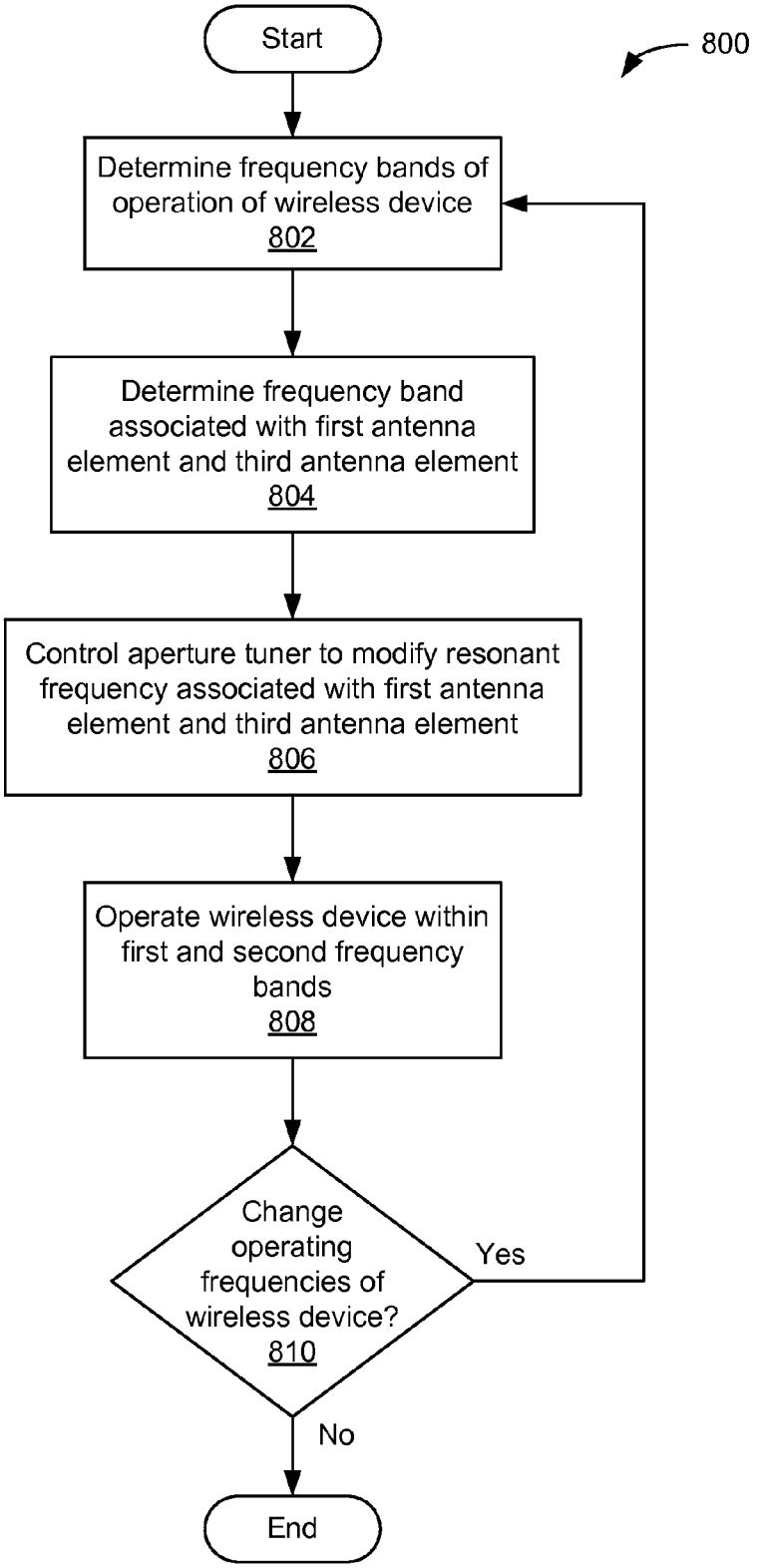
FIG. 8 shows an illustrative flow chart depicting an exemplary operation for the wireless device of FIG. 1, in accordance with exemplary embodiments.

FIG. 8 shows an illustrative flow chart depicting an exemplary operation 800 for wireless device 110, in accordance with some exemplary embodiments. Referring also to FIGS. 4-7, frequency bands of operation of wireless device 110 are determined (802). In some exemplary embodiments, wireless device 110 may operate within a first frequency band and a second frequency band. For example, transmit circuits 252*pa* may operate within the first frequency band and transmit circuits 252*pk* may operate within the second frequency band.

Next, a frequency band associated with first antenna element 510 and third antenna element 530 are determined (804). Wireless device 110 may include first antenna element 510, third antenna element 530, and aperture tuner 507. First antenna element 510 and third antenna element 530 may be selected to radiate and/or receive RF signals within the first frequency band or the second frequency band. In some exemplary embodiments, the frequency band associated with first antenna element 510 and third antenna element 530 may be determined, at least in part, on a range of frequencies that first antenna element 510 and third antenna element 530 may support.

Next, aperture tuner 507 is controlled to modify the resonant frequency associated with first antenna element 510 and third antenna element 530 (806). For example, aperture tuner 507 may be used to modify the resonant frequency associated with third antenna element 530 based on the frequency band determined at 804.

Next, wireless device 110 operates within the first frequency band and/or the second frequency band (808). For example, wireless device 110 may transmit and/or receive RF signals within the first frequency band and/or the second frequency band through first antenna element 510 and second antenna element 520, and/or first antenna element 510 and third antenna element 530. In some exemplary embodiments, wireless device 110 may transmit and/or receive RF signals within the first frequency band and the second frequency band simultaneously. Next, a change of operating frequencies for wireless device 110 is determined (810). If operating frequencies are to be changed, then operations proceed to 802. If operating frequencies are not to be changed, then operations end.

The various illustrative logical blocks, modules, and circuits described in connection with the exemplary embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media.

In the foregoing specification, the exemplary embodiments have been described with reference to specific exemplary embodiments thereof. It will, however, be evident that various modifications and changes may be made thereto without departing from the broader scope of the disclosure as set forth in the appended claims. The specification and drawings are, accordingly, to be regarded in an illustrative sense rather than a restrictive sense.

What is claimed is:

1. An apparatus comprising:

a first antenna element disposed on a substrate including a first portion configured to integrally form a reference plane; and a second antenna element including:

a first portion substantially parallel to the substrate and separated from the first antenna element by a first gap, the first antenna element and the second antenna element configured to radiate a first RF signal within a first frequency band; and a second portion configured to couple the first portion of the second antenna element to the first antenna element and configured to extend substantially perpendicular from the first antenna element and the substrate.

2. The apparatus of claim 1, the first antenna element further including a second portion configured to receive the first RF signal through a feed point and a third portion configured to form a first end of the first antenna element.

3. The apparatus of claim 2, wherein the first portion of the first antenna element is configured to form a second end of the first antenna element.

4. The apparatus of claim 1, wherein the second antenna element is configured to allow one or more circuit components to be mounted upon the first antenna element within the first gap.

5. The apparatus of claim 1, further comprising:

a parasitic antenna element configured to inductively couple to the first antenna element and to radiate RF signals within in the first frequency band.

6. The apparatus of claim 1, the first portion of the second antenna element including:

a first surface proximally oriented to the first antenna element; and a second surface distally oriented to the first antenna element.

7. The apparatus of claim 1, further comprising:

a third antenna element substantially parallel to the substrate and separate from the first antenna element by a second gap, wherein the first antenna element and the third antenna element are configured to radiate RF signals within a second frequency band, different from the first frequency band and the third antenna element is coupled to the first antenna element via an aperture tuner.

8. The apparatus of claim 7, wherein the aperture tuner is configured to adjust a resonant frequency associated with the third antenna element and the first antenna element.

9. The apparatus of claim 8, wherein the aperture tuner is further configured as a low pass filter.

10. The apparatus of claim 8, the aperture tuner comprising at least one of a variable capacitor or an inductor or a switch or a combination thereof.

11. The apparatus of claim 8, the aperture tuner comprising a variable capacitor coupled to the reference plane through the first antenna element.

12. The apparatus of claim 1, further comprising:

a feed point configured to simultaneously receive the first RF signal and a second RF signal within a second frequency band, the second frequency band different from the first frequency band.

13. An apparatus comprising:

a first means for radiating a first radio frequency (RF) signal, wherein the first means is disposed on a substrate and integrally forms a reference plane; and a second means for radiating the first RF signal substantially parallel to the substrate and separate from the first means by a first gap, the first RF signal associated with a first frequency band; and a means for coupling the second means for radiating the first RF signal to the first means for radiating the first RF signal and extending substantially perpendicular from the first means for radiating the first RF signal.

14. The apparatus of claim 13, further comprising:

a first means for radiating a second RF signal substantially parallel to the substrate and separate from the first means for radiating the first RF signal and forming a second gap with the first means for radiating the first RF signal, wherein the second RF signal is associated with a second frequency band that is different from the first frequency band; and a means for coupling the first means for radiating the second RF signal to the first means for radiating the first RF signal.

15. The apparatus of claim 14, further comprising:

a means for simultaneously receiving the first RF signal and the second RF signal.

16. A method, comprising:

radiating a radio frequency (RF) signal through a first antenna element disposed on a substrate configured to integrally form a reference plane; and radiating the RF signal through a first portion of a second antenna element substantially parallel to the substrate and separated from the first antenna element by a first gap and a second portion of the second antenna element coupling the first portion of the second antenna element to the first antenna element and extending substantially perpendicular from the first antenna element and the substrate.

* * * * *